US006915098B2

(12) United States Patent
Matsumoto

(10) Patent No.: US 6,915,098 B2
(45) Date of Patent: Jul. 5, 2005

(54) TONER FIXING DEVICE FOR AN IMAGE FORMING APPARATUS

(75) Inventor: Hirotaka Matsumoto, Yokohama (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 43 days.

(21) Appl. No.: 10/430,394

(22) Filed: May 7, 2003

(65) Prior Publication Data

US 2003/0210937 A1 Nov. 13, 2003

(30) Foreign Application Priority Data

May 9, 2002 (JP) ..... 2002-134068

(51) Int. Cl.[7] ..... G03G 15/20
(52) U.S. Cl. ..... 399/327
(58) Field of Search ..... 399/327, 324, 399/13

(56) References Cited

U.S. PATENT DOCUMENTS 5,970,872 A * 10/1999 Iwamoto et al.
6,016,409 A * 1/2000 Beard et al. ..... 399/327
6,618,572 B2 * 9/2003 Morganti et al. ..... 399/327
6,725,008 B2 * 4/2004 Morganti et al. ..... 399/327
6,771,925 B2 * 8/2004 Satoh ..... 399/327

FOREIGN PATENT DOCUMENTS

JP 10-129875 A 5/1998
JP 10149048 A * 6/1998 ..... G03G/15/20
JP 2893815 B2 3/1999

* cited by examiner

*Primary Examiner*—Susan Lee
(74) *Attorney, Agent, or Firm*—Foley & Lardner LLP

(57) ABSTRACT

A fixing device of this invention takes up web slack prior to image formation when a cleaning mechanism is dismounted from the fixing device or a web reaches its end. This can prevent a poor-quality image generated by web slack upon replacing the cleaning mechanism.

23 Claims, 6 Drawing Sheets

TONER FIXING DEVICE FOR AN IMAGE FORMING APPARATUS

CROSS-REFERENCE TO RELATED APPLICATIONS

This application is based upon and claims the benefit of priority from the prior Japanese Patent Application No. 2002-134068, filed May 9, 2002, the entire contents of which are incorporated herein by reference.

BACKGROUND OF THE INVENTION

1. Field of the Invention

The present invention relates to a fixing device which is employed in, e.g., a copying machine or printer apparatus using toner, and fixes a toner image onto a medium to be transferred.

2. Description of the Related Art

A fixing device which is assembled into a copying machine using an electrophotographic process heats and melts toner on a medium to be transferred, and fixes the toner onto the medium.

As a toner heating method usable in the fixing device, a method using radiation heat obtained by turning on a filament lamp, and a flash-fixing method using a flash lamp have widely been known. Recently, a fixing device using an induction heating device as a heat generation source is put into practical use.

In many cases, the fixing device uses a heat (fixing) roller which incorporates a heater, and a press roller which is pressed against the heat roller at one point on the outer surface of the heat roller at a predetermined pressure. With this structure, heat can be efficiently supplied from the heat generation source to toner. A pressure for fixing melted toner onto a medium to be transferred can be easily applied to the medium and toner.

Most of toners used in a copying machine and printer apparatus are granular particles or powder particles prepared by coating a pigment or dye with a hot-melt resin. Toner which is not fixed to a medium to be transferred often remains at a portion of the fixing device which contacts melted toner. Thus, many fixing devices having a cleaning device which recovers toner left on the heat roller are commercially available.

As a method of cleaning the heat roller, felt is brought into contact with the outer surface of the heat roller, and oil which prevents toner from attaching to the heat roller is supplied. Toner is fixed to a portion where it is brought into contact with the heat roller in the use of felt. Thus, the felt is formed into a roller shape to prevent toner from being fixed to one portion.

Even with the felt roller, the toner catchable amount decreases and the image quality degrades during the maintenance cycle because of an increase in the image forming speed of a copying machine and printer apparatus and prolongation of the maintenance cycle of the copying machine and printer apparatus. If felt containing a large amount of toner is pressed against the heat roller for a long time, the heat roller surface is scratched.

To solve these problems, a web cleaning method of changing (shifting) the position of felt brought into contact with the heat roller in accordance with the cumulative image forming count (lapse of a predetermined time).

In the use of the felt web, the web containing toner is sequentially taken up. The replacement time of the cleaning device can be set by setting the web amount in accordance with the maintenance cycle. The web may be coated with oil which prevents toner from attaching to the heat roller.

Even if the felt web is adopted, the web amount assembled into the fixing device has an end portion (roll length) due to the maintenance cycle, the internal space of the apparatus, and the like.

Hence, the web must be replaced at the end of the web of the cleaning mechanism within the total operatable time (apparatus life) which is set in advance in the image forming apparatus.

Immediately after the web of the cleaning mechanism is replaced, an unnecessary web portion which is not taken up by the web-taking unit may be caught between the heat roller or belt of the fixing device and the press roller.

If the web is caught between the heat roller (belt) and the press roller, the heat roller surface is scratched and cannot be used (must be replaced) in the worst case. Replacement of the heat roller requires a long time and high cost.

When an unnecessary web portion is caught between the heat roller (belt) and the press roller although the heat roller need not be replaced, the web scrapes toner which is transferred and electrostatically attached to a sheet to be output in subsequent image formation. As a result, normal image formation may fail.

Even if the untaken web is not caught between the heat roller (belt) and the press roller, the web may not always be normally conveyed every predetermined number of image forming operations at a cleaning position where the web is in contact with the heat roller until an unnecessary web portion is completely taken up by the recovery side and the web normally functions. In this case, toner attached to the web may damage the heat roller surface.

Even when the heat roller surface is not damaged, the heat roller surface is not always satisfactorily cleaned, and an output sheet (printout) may be undesirably contaminated with toner. In a fixing device in which the heat roller is coated with oil serving as a release agent by using the web of the cleaning mechanism, the oil amount becomes unstable immediately after the web is replaced.

BRIEF SUMMARY OF THE INVENTION

It is an object of the present invention to provide an image forming apparatus capable of operating a cleaning mechanism so as to suppress formation of any undesired image in the image forming apparatus using a fixing device with the cleaning mechanism.

According to a first aspect of the present invention, there is provided a fixing device comprising:

a heat-producing member which is formed into a hollow cylinder or an endless belt, has a outer surface of the cylinder or a belt surface of the belt movable at a predetermined speed, and can supply predetermined heat to a hot-melt substance and a medium holding the hot-melt substance;

a pressure application mechanism which has a outer surface that can move following the outer surface of the cylinder or the belt surface of the belt when the outer surface of the cylinder or the belt surface of the belt of the heat-producing member is moved at the predetermined speed, and which applies a predetermined pressure to the heat-producing member while interposing the hot-melt substance and the medium between the heat-producing member and the pressure application mechanism;

a heat-producing heating mechanism which is set in the heat-producing member, and allows the heat-producing member to generate heat;

a hot-melt substance-taking member which is in contact with the outer surface of the cylinder or the belt surface of the belt of the heat-producing member to be heated at a predetermined pressure, and can recover the hot-melt substance attached to the outer surface of the cylinder or the belt surface of the belt;

a hot-melt substance-taking member changer which can move the hot-melt substance taking member by a predetermined amount in a region where the hot-melt substance-taking member is in contact with the outer surface of the cylinder or the belt surface of the belt of the heat-producing member at the predetermined pressure when a predetermined amount of the hot-melt substance is attached to the hot-melt substance-taking member; and a hot-melt substance-taking member changer control device which moves the hot-melt substance-taking member at a predetermined timing in the region where the hot-melt substance-taking member is in contact with the outer surface of the cylinder or the belt surface of the belt of the heat-producing member, and when the hot-melt substance-taking member is released from the contact with the outer surface of the cylinder or the belt surface of the belt of the heat-producing member and then mounted again, or when the hot-melt substance-taking member is replaced on the basis of replacement time, moved a predetermined amount of the hot-melt substance recovery member prior to image formation.

According to a second aspect of the present invention, there is provided an image forming apparatus comprising:

an image carrier which holds an electrostatic image corresponding to image information supplied as brightness and darkness of light;

a developing device which supplies toner to the electrostatic image formed on the image carrier and develops the electrostatic image;

a fixing device has a heating member for supplying predetermined heat to a toner transferred onto a medium to be transferred and a pressuring member capable of applying a predetermined pressure to the heating member, the fixing device fixes the toner developed by the developing device to the medium to be transferred that is conveyed between the heating member and the pressing member;

a cleaning mechanism which includes a web that is arranged to be able to contact the heating member of the fixing device at a predetermined pressure during supply from a supply end to an arriving-end, and be able to change by a predetermined amount a position where the web is in contact with the heating member of the fixing device by recovering the web to the arriving-end when the medium to be transferred passes through the fixing device a predetermined number of times, and that supplies a predetermined amount of oil serving as a release agent to the heating member and removes toner which is not transferred to the medium to be transferred and remains; and a control mechanism which determines whether the cleaning mechanism has not been mounted before or has already been mounted in the fixing device, and when the cleaning mechanism is determined not to have been mounted before, causes the recovery end to take up the web by a predetermined amount.

According to a third aspect of the present invention, there is provided an image forming apparatus including a fixing device with a web cleaning mechanism, comprising:

a web dismounting detection mechanism which detects that the web cleaning mechanism is dismounted for web replacement and then mounted again; and a web feed control mechanism which, when the web dismounting detection mechanism detects that the web cleaning mechanism is mounted, determines whether the mounted web cleaning mechanism has not been mounted before or has already been mounted, and when the web cleaning mechanism is determined not to have been mounted before, causes a web-taking unit to take up a web of the web cleaning mechanism by a predetermined amount.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

A digital copying machine will be described below with reference to the several views of the accompanying drawing as an example of an image forming apparatus to which a preferred embodiment of the present invention is applied.

Figure 1:
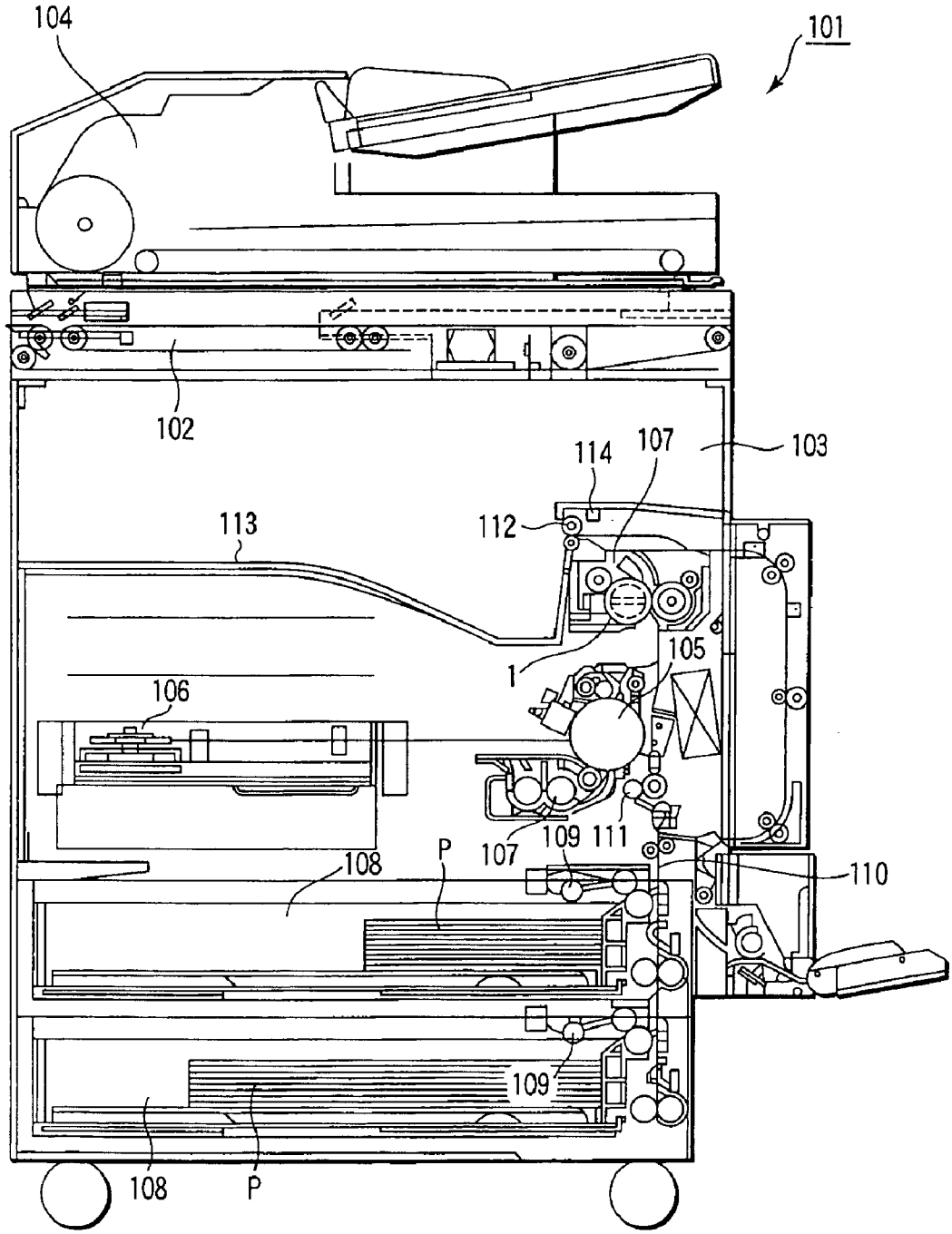
FIG. 1 is a schematic view for explaining an example of an image forming apparatus which incorporates a fixing device according to the present invention.

As shown in FIG. 1, a digital copying machine (image forming apparatus) 101 includes an image reading device (scanner) 102 and image forming section 103. The scanner 102 catches an image to be copied as the brightness and darkness of light, photoelectrically converts the image, and generates image data. The image forming section 103 forms an image corresponding to image data supplied from the scanner 102 or externally, and fixes the image onto a sheet P serving as a medium to be transferred. The scanner 102 is integrated with an automatic document feeder (ADF) 104 functioning as a cover for pressing an object to be copied against the reading surface, i.e., document table (not to be described in detail) of the scanner 102. As is known well, when the object to be copied is a sheet, the ADF 104 eliminates a step of opening/closing the ADF 104 from/to the document table for each sheet and pressing an object to be copied against the document table. The ADF 104 allows sequentially replacing objects to be copied in association with reading operation of images to be copied by the scanner 102.

The image forming section 103 has a cylindrical photosensitive drum 105 whose outer surface is covered with a photosensitive member. When light irradiates the photosensitive drum while a predetermined potential is applied, the potential of a region irradiated with light changes. The photosensitive member can hold a change of the potential as an electrostatic image for a predetermined time.

The photosensitive drum 105 is exposed to image information to be output by an exposure device 106 capable of outputting a laser beam which is changed in light intensity in correspondence with image data supplied from the scanner 102 or an external device. An image is then formed as the change of the potential corresponding to the electrostatic image, i.e., image data on the outer surface of the photosensitive drum 105.

The image formed on the photosensitive drum 105 is visualized by selectively supplying toner from a developing device 107.

By applying a transfer voltage from a transfer device (not to be described in detail), a toner member, i.e., toner image which is developed on the photosensitive drum 105 by supplying toner from the developing device 107 is transferred onto a sheet P fed to a transfer position in the following step. In order to transfer a toner image at the transfer position, sheets P are picked up one by one from a cassette 108 by a pickup roller 109. Each sheet P is conveyed up to an aligning roller 111 in advance via a convey path 110 defined between the photosensitive drum 105 and the cassette 108. The aligning roller 111 is rotated at a predetermined timing in order to align the sheet P with the toner image formed on the photosensitive drum 105. The sheet P conveyed up to the aligning roller 111 is aligned with the toner image on the photosensitive drum 105 and supplied to the transfer position.

By moving the sheet P, the toner image transferred onto the sheet P by the transfer device is conveyed to a fixing device 1. The toner image transferred onto the sheet P is melted by heat and a pressure from the fixing device 1, and fixed onto the sheet P by a pressure applied by the fixing device 1.

The sheet P with the toner image fixed by the fixing device 1 is output and stacked to an output tray 113 by an output roller 112 serving as a space defined between the sheet cassette 108 and the scanner 102. The number of printouts (sheets) discharged on the discharge tray 113 is counted by a discharge counter 114.

Figure 2:
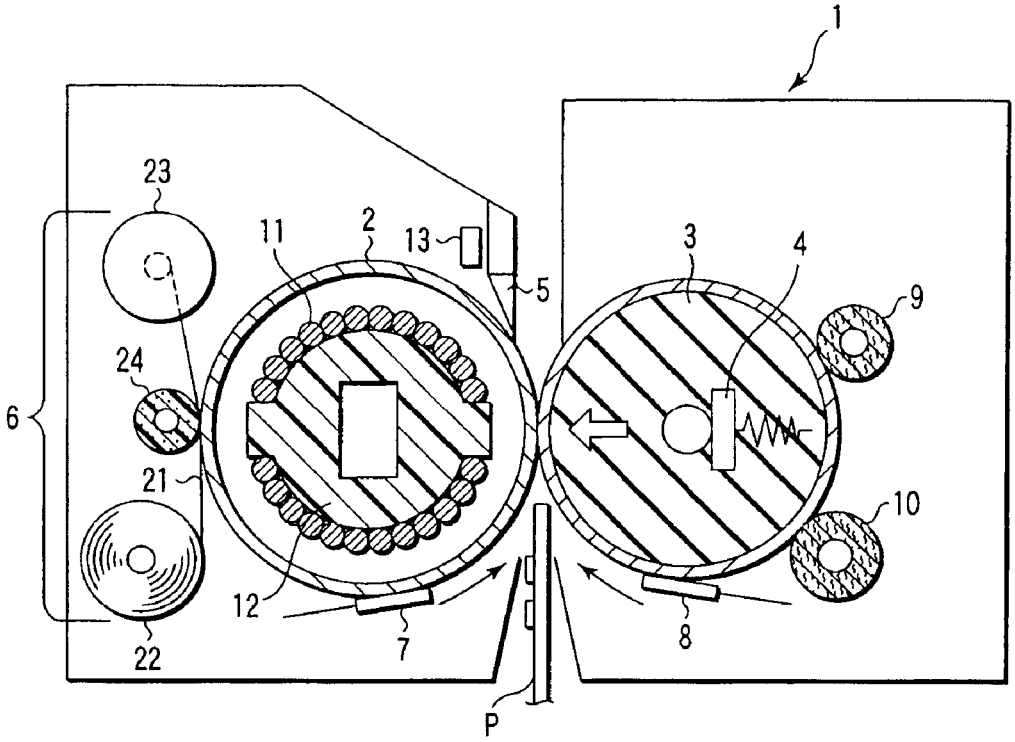
FIG. 2 is a schematic view for explaining an example of the fixing device which can be used in the image forming apparatus shown in FIG. 1.
Figure 3:
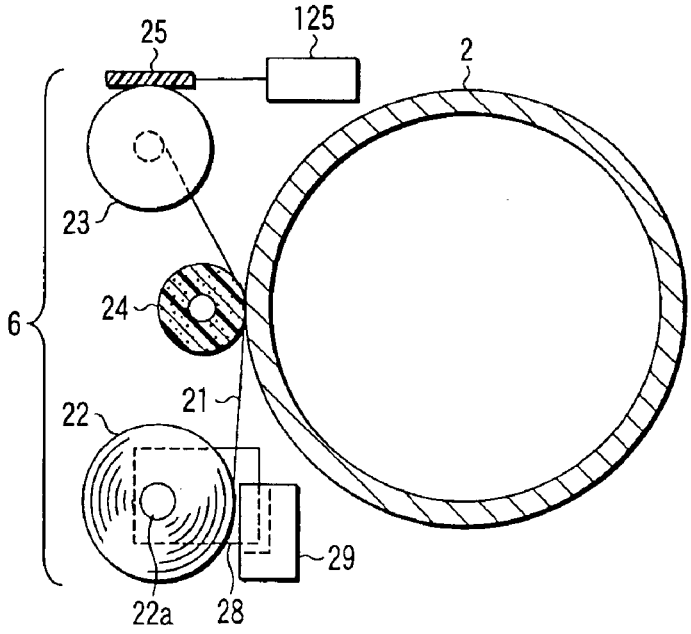
FIG. 3 is a schematic view for explaining an example of a web cleaning mechanism used in the fixing device shown in FIG. 2.

FIGS. 2 and 3 are schematic views for explaining an example of the fixing device used in the image forming apparatus shown in FIG. 1. FIG. 3 shows in detail a web type cleaner which is integrated into the fixing device 1 shown in FIG. 2. A fixing device using an induction heating type heating mechanism will be exemplified in FIGS. 2 and 3, but the heating mechanism can be of any type.

The fixing device 1 includes a heating (fixing) roller 2 with a diameter of about 60 mm and a press roller 3 with a diameter of about 60 mm.

The heat roller 2 is made of a metal with a thickness of about 2 mm, and is a hollow cylinder in this example. A release (parting) layer (not shown) obtained by depositing a fluoroplastic such as tetrafluoroethylene resin to a predetermined thickness is formed on the surface of the heat roller 2. The roller material of the heat roller 2 can be stainless steel, iron, nickel, aluminum, an alloy of stainless steel and aluminum, or the like. The length of the heat roller 2 is about 340 mm in this embodiment. Note that the heat roller 2 may be replaced by a metal film formed from an endless belt of a sheet member prepared by depositing a metal to a predetermined thickness on the surface of a heat-resistant resin film.

The press roller 3 is an elastic roller prepared by coating a rotating shaft having a predetermined diameter with silicone rubber, fluororubber, or the like having a predetermined thickness. The length of the press roller 3 is about 320 mm.

The press roller 3 is almost parallel to the axis of the heat roller 2, and pressed by a press mechanism 4 with respect to the axis of the heat roller 2 at a predetermined pressure. Part of the outer surface of the press roller 3 elastically deforms, defining a predetermined nip between the two rollers. When the metal film is used instead of the heat roller 2, the nip may be formed on the film side.

The heat roller 2 is rotated in a direction indicated by an arrow at an almost constant speed by a fixing motor 123 (see FIG. 4) or a drum motor 121 (see FIG. 4) which rotates the photosensitive drum 105.

When the heat roller 2 is rotated, the press roller 3 is rotated at a predetermined speed together with the heat roller 2. This is because the press roller 3 is in contact with the heat roller 2 by the press mechanism 4 at a predetermined pressure.

A separation claw 5 which peel a sheet P having passed through the nip from the heat roller 2 is located at a predetermined position on the outer surface of the heat roller 2 near the nip on the downstream side of the nip (contact point) between the heat roller 2 and the press roller 3 in a direction in which the roller 2 is rotated.

A web cleaning mechanism 6 and thermistor 7 are sequentially arranged around the heat roller 2 so as to be spaced apart from the separation pawl 5 along the direction in which the roller 2 is rotated.

The web cleaning mechanism 6 is used to remove (clean) toner offset on the heat roller 2 and dust particles of paper from a sheet serving as a medium to be transferred. The web cleaning mechanism 6 is also used to coat a release agent (e.g., silicone oil) for preventing toner from being fixed onto the release layer of the heat roller 2.

The thermistor 7 is used to detect the surface temperature of the roller 2. The thermistor 7 can be arranged at an arbitrary position on the circumference of the roller 2 (phase when viewed from the direction of section need not be set). Two or more thermistors may be arranged.

A thermistor 8, oil roller 9, and cleaning roller 10 are arranged on the outer surface of the press roller 3. The thermistor 8 detects the temperature of the outer surface of the press roller 3. The oil roller 9 applies a release agent such as silicone oil to the outer surface of the press roller 3. The cleaning roller 10 removes, e.g., toner attached to the outer surface of the press roller 3.

The heat roller 2 incorporates an exciting coil 11 which causes the material of the roller 2 to generate an eddy current. The exciting coil 11 is formed into a length enough to heat a sheet by a width by which the sheet is in contact with the outer surface of the roller 2 when, e.g., an A4-size sheet is conveyed with its short side parallel to the axis of the heat roller 2.

The exciting coil 11 is formed from a litz wire as a bundle of a plurality of, in this example 16 wires prepared by insulating copper wires with a diameter of, e.g., 0.5 mm from each other by heat-resistant polyamide-imide. Since the exciting coil 11 is formed from the litz wire, the diameter of each wire can be set smaller than the permeation depth of the skin effect which occurs when a high-frequency AC current flows through the wire. As a result, a high-frequency current can be effectively supplied.

The exciting coil 11 is an air-core coil wound around a coil holding member 12 made of engineering plastic or ceramic which exhibits high heat resistance and high insulating property. The coil holding member 12 can be made of PEEK (poly ether ether ketone), phenol, unsaturated polyester, or the like. The wire which forms the exciting coil 11 can be arbitrarily wound. In the example shown in FIG. 2, the coil holding member 12 is shaped, and a flat coil is wound along the inner surface of the heat roller 2.

An example of the web cleaning mechanism will be explained with reference to FIG. 3.

The web cleaning mechanism 6 has a web supply member 22 and web-taking member 23. The web supply member 22 is wound by a predetermined length with a web 21 prepared by forming into, e.g., a felt sheet a chemical fiber which can resist the high temperature of the heat roller 2, e.g., 220° C. The web-taking member 23 takes up the web 21 by a predetermined amount.

The web 21 contains in advance a predetermined amount of silicone oil serving as a release agent. The thickness of the web 21 is, e.g., 54 $\mu$m.

A press roller 24 is interposed between the web supply member 22 and the web-taking member 23. The press roller 24 brings the web 21 which is suspended from the web supply member 22 to the web-taking member 23, into contact with the outer surface of the heat roller 2 at a predetermined pressure.

An arbitrary region on the outer surface of the heat roller 2 always contacts the web 21 by rotating the heat roller 2. A predetermined amount of silicone oil is supplied to the outer surface of the heat roller 2, forming an oil thin layer.

The press roller 24 is formed from a sponge with a hardness of, e.g., 30° and an outer diameter of 20 mm. The press roller 24 is slightly rotated upon movement of the web 21 when the web 21 is recovered by the web-taking member 23 by a driving mechanism to be described later. This prevents elastic deformation of the roller 24 at a pressure when the web 21 is pressed against the press roller 3.

Figure 4:
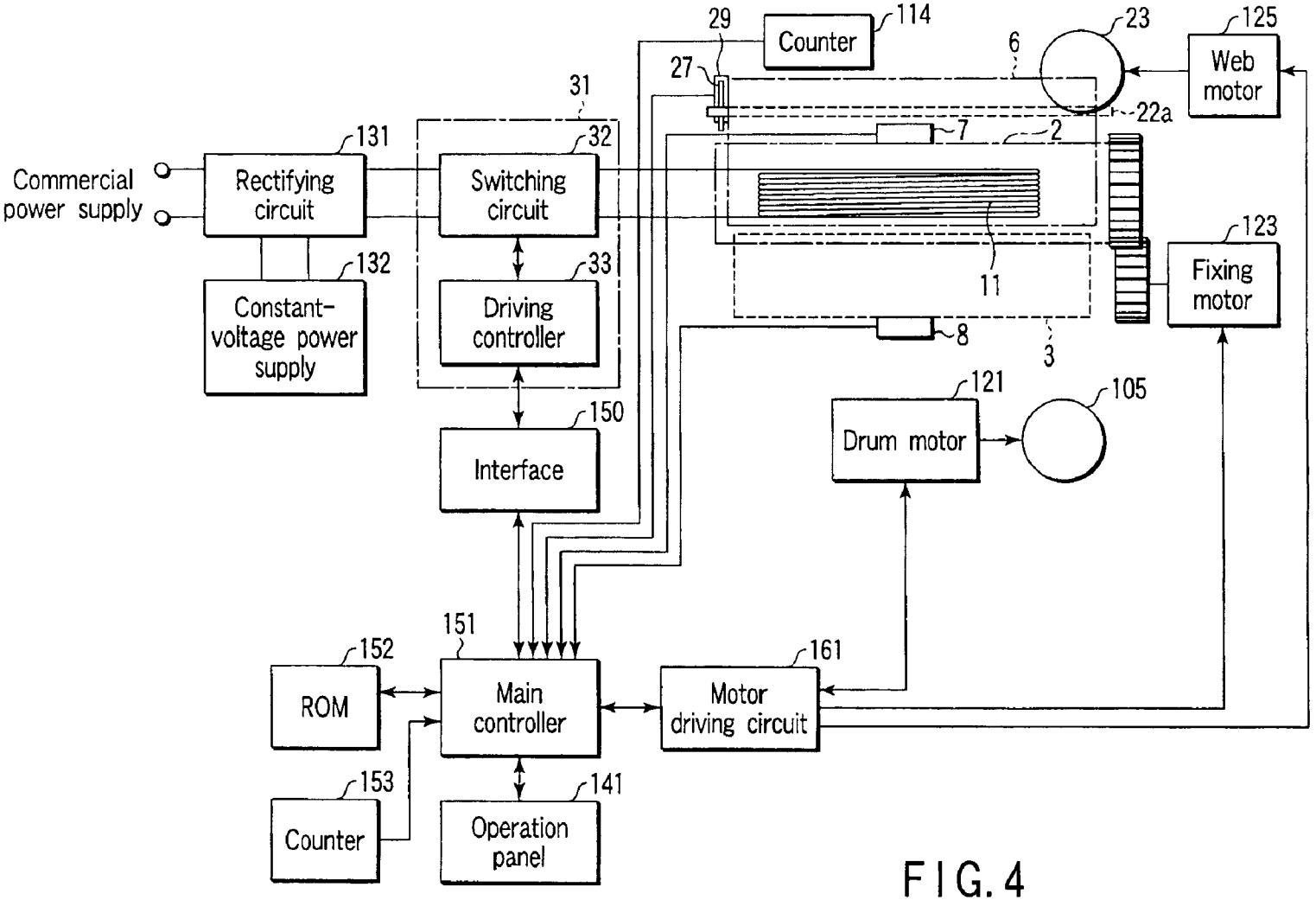
FIG. 4 is a schematic block diagram for explaining a control system for the fixing device shown in FIGS. 2 and 3 and the image forming apparatus shown in FIG. 1.

The web-taking member 23 is rotated by a predetermined amount at a predetermined timing by a rotation transfer mechanism 25 such as a gear train or a set of a belt and wheel which is rotated by a web motor 125 (see FIG. 4). An amount (to be referred to as a web feed amount hereinafter) by which the web 21 is moved by one operation is 0.3 mm for an image forming count of 10 (10 printouts) in the fixing device shown in FIG. 2, i.e., the digital copying machine 101 shown in FIG. 1.

FIG. 4 is a schematic view for explaining an example of a control circuit for operating the fixing device and web cleaning mechanism shown in FIGS. 2 and 3.

As described above, the heat roller 2 of the fixing device 1 incorporates the exciting coil 11 for causing the metal material of the heat roller 2 to generate an eddy current, thus generating heat. The exciting coil 11 is connected to an exciting unit 31 which supplies a high-frequency output having a predetermined frequency to the exciting coil 11.

The exciting unit 31 includes a switching circuit 32 and driving controller 33. The switching circuit 32 can output a high-frequency output with a predetermined frequency which is to be supplied across the exciting coil 11. The driving controller 33 supplies a control signal for causing the switching circuit 32 to output a high-frequency output with a predetermined frequency.

The switching circuit 32 receives a DC voltage from a rectifying circuit 131 which rectifies an AC voltage received from a commercial power supply and supplies a DC voltage. The operation power supply of the driving controller 33 utilizes a voltage obtained by adjusting a rectified output from the rectifying circuit 131 into a constant voltage by a constant-voltage circuit 132 in order to suppress the influence of a change in voltage which returns via the switching circuit 32 upon a change in output from the exciting coil 11.

The driving controller 33 is connected to a main controller 151 of the image forming section 103 via an interface 150. The driving controller 33 determines a frequency to be output from the switching circuit 32 in accordance with an output from the thermistor 7 which is a detection output as a result of detecting the temperature of the outer surface of the heat roller 2, an output from the thermistor 8 which is a detection output as a result of detecting the temperature of the outer surface of the press roller 3, and a control signal input from the main controller 151 of the image forming section 103. The driving controller 33 then sets the frequency of a high-frequency output from the switching circuit 32.

The main controller 151 of the image forming section 103 is connected to a motor driving circuit 161 which rotates a motor to be described later at a predetermined rotational speed.

The copying machine 101 shown in FIG. 1 incorporates the drum motor 121, fixing motor 123, and web motor 125. The drum motor 121 rotates the photosensitive drum 105 at a predetermined rotational speed. The fixing motor 123 rotates the heat roller 2 of the fixing device 1, and the web motor 125 rotates the web-taking member 23 of the web cleaning mechanism 6.

More specifically, when the main controller 151 designates rotation of an arbitrary motor, the motor driving circuit 161 supplies a predetermined number of motor driving pulses to a corresponding motor. The fixing motor 123 may be omitted, and rotation of the drum motor 121 may be transferred to the heat roller 2.

The main controller 151 receives an arbitrarily changeable web feed amount corresponding to each condition and a timing (condition) at which the web 21 is moved, i.e., an amount by which the web-taking member 23 is rotated. The timing (condition) at which the web 21 is moved is stored in, e.g., a ROM 152, and can be changed, as needed. The web feed amount stored in the ROM 152 can also be changed using, e.g., a control panel 141 connected to the main controller 151.

The main controller 151 compares the length of the web 21 that is stored in the ROM 152 with the count value of a counter 153 which counts the cumulative image forming count. If the main controller 151 estimates that the remaining length of the web 21 becomes shorter than a predetermined length, the main controller 151 can display, e.g., "a message which requests replacement of the web 21" on a display 142 of the operation panel 141.

Web feed amount control as a feature of the present invention will be described in detail.

When the web cleaning mechanism 6 of the fixing device 1 is replaced for maintenance (web replacement), an unnecessary web portion before the web 21 of a new web cleaning mechanism 6 is taken up by the web-taking member 23 may be caught between the heat roller 2 and press roller 3 of the fixing device 1. Further, the web 21 may not always be normally conveyed every predetermined number of image forming operations at a cleaning position where the web 21 is in contact with the heat roller 2 until an unnecessary portion of the web 21 is completely taken up by the web-taking member 23 and the web 21 normally functions.

In the cleaning mechanism 6 of the present invention, the heat roller 2 is coated with oil (not shown) serving as a release agent. The oil amount may become unstable immediately after the web is replaced.

Figure 5:
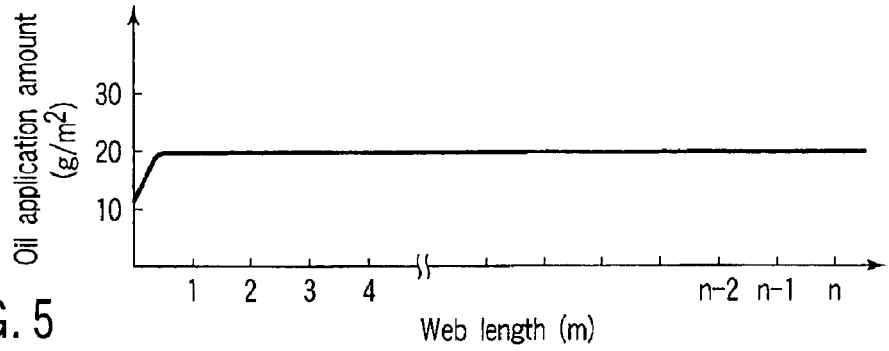
FIG. 5 is a graph for explaining changes in the taking-up amount of a web from the web supply member to web-taking member of the web cleaning mechanism and the amount of supplying, to a heat roller surface, oil serving as a release agent which is impregnated in the web in advance.

FIG. 5 shows changes in the taking-up amount of the web from the web supply member to web-taking member of the web cleaning mechanism and the amount of supplying, to the heat roller surface, oil serving as a release agent which is impregnated in the web in advance.

As shown in FIG. 5, as for several turns from the outermost turn while an unused web 21 is wound around the web supply member 22, oil which is impregnated in the web 21 in advance may not be uniformly supplied to the heat roller 2, which depends on the stock state of the cleaning mechanism 6. For example, the thickness of the web 21 is 54 $\mu$m, the total winding length (of the web 21) around the supply member 22 is 22 m, and the oil amount supplied to the heat roller 2 is 20 g/m$^2$ (see FIG. 6). In this case, it has been confirmed that the oil amount supplied to the heat roller 2 can be made uniform by taking up, by about 0.5 m, the web 21 wound around the supply member 22.

From this, when a web cleaning mechanism 6 with an unused web 21 is mounted in the fixing device 1, the web 21 is preferably taken up by the web-taking member 23 by a predetermined length, i.e., until the oil amount supplied to the heat roller 2 reaches a predetermined amount and becomes almost uniform prior to image formation regardless of whether to repeat image formation. The length of the web taken up prior to image formation is arbitrarily set in accordance with the oil amount supplied to the web while the web is wound, the winding state of the web wound around the web supply member (the outer diameter, i.e., winding pressure of the web wound around the supply member 22), and the like.

Figure 6:
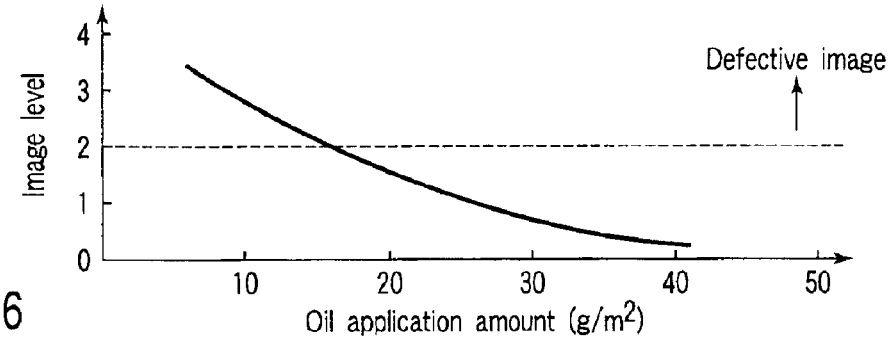
FIG. 6 is a graph for explaining the oil amount supplied to the heat roller surface and the degree of image contamination on a printout (output image)

FIG. 6 shows the oil amount (g/m$^2$) supplied to the heat roller surface and the degree of image contamination on a printout (output image). For example, image contamination on a printout is represented by five levels, and image contamination up to the second level (intermediate value including 0) falls within the tolerance. It has been confirmed that image contamination exceeds the tolerance when the oil amount supplied to the surface of the roller 2 is about 10 g/m$^2$.

The lower limit of oil supplied to the heat roller 2 via the web 21 is about 20 g/m$^2$, as described above with reference to FIG. 5.

Figure 7:
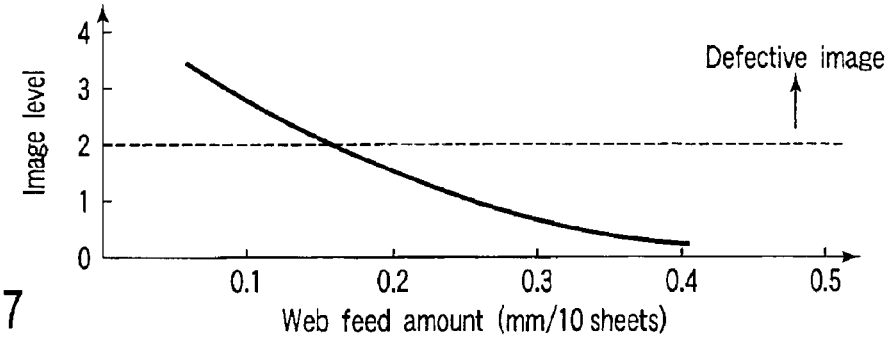
FIG. 7 is a graph for explaining the timing at which the position where the web is in contact with the heat roller is changed, and the degree of image contamination on a printout (output image)

FIG. 7 shows the timing at which the position where the web is in contact with the heat roller is changed, and the degree of image contamination on a printout (output image). Note that oil is supplied via the web to a predetermined thickness on the heat roller surface.

As shown in FIG. 7, when a predetermined amount of oil serving as a release agent is supplied to the surface of the heat roller 2, image contamination on a printout is represented by five levels, and image contamination up to the second level (intermediate value including 0) falls within the tolerance. The web 21 in contact with the surface of the heat roller 2 is moved by an amount of 0.1 to 0.4 mm every 10 image forming operations. In this case, it has been confirmed that image contamination exceeds the tolerance when the moving amount of the web 21 is smaller than 0.2 mm. In the fixing device 1 of the present invention, the web feed amount is set to 0.3 mm/10 image forming operations, as described above.

Figure 8:
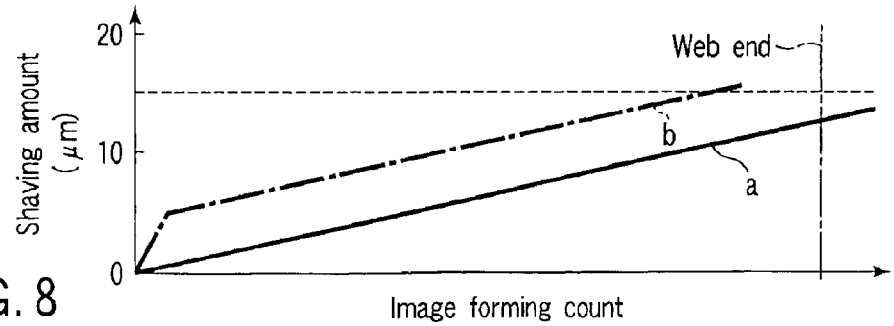
FIG. 8 is a graph for explaining undesired wear of the heat roller surface when the web cleaning mechanism is replaced and the web is not normally taken up every image formation due to web slack which may occur at the start of image formation without taking up an unnecessary web portion.

FIG. 8 shows undesired wear of the heat roller surface when the web cleaning mechanism is replaced and the web is not normally taken up every image formation due to web slack which may occur at the start of image formation without taking up an unnecessary web portion.

As is apparent from FIG. 8, the wear of the surface of the heat roller 2 every repetitive image formation cannot be avoided. In general, the web feed amount is set such that the wear of the surface of the heat roller 2 falls within a predetermined range within the image forming count required for the fixing device 1, as represented by the curve a. Oil serving as a release agent is also supplied in a proper amount.

However, if image formation starts with slack in the web 21 after the web cleaning mechanism 6 is replaced, the web 21 containing toner may not be normally taken up and rub against the surface of the heat roller 2, as described above. In this case, as represented by the curve b, the surface of the heat roller 2 undesirably wears, failing in image formation even within the image forming count required for the fixing device 1.

Figure 9:
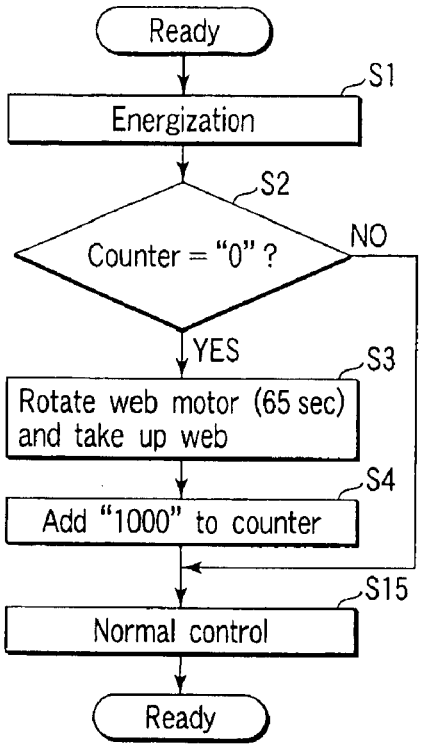
FIG. 9 is a flow chart for explaining an example of web feed control in replacing a web cleaning mechanism capable of suppressing the wear of the heat roller surface shown in FIG. 8 within a predetermined range while satisfying the web feed condition and oil application amount to the heat roller shown in FIGS. 5 to 7.

FIG. 9 shows an example of web feed control upon replacing a web cleaning mechanism capable of suppressing the wear of the heat roller surface shown in FIG. 8 within a predetermined range while satisfying the web feed condition and oil application amount to the heat roller shown in FIGS. 5 to 7. Whether the web cleaning mechanism has been replaced can be easily detected by arranging, e.g., a dismounting detection mechanism to be described later with reference to FIGS. 10A and 10B.

As shown in FIG. 9, if the copying machine 101 is energized (power supply is turned on) at an arbitrary timing (S1), whether the counter 153 exhibits "0" is checked (S2).

If the count value of the counter 153 is "0" in step S2 (YES in S2), the web motor 125 is rotated for a predetermined time, e.g., 65 sec, and an unnecessary portion of the web 21 is recovered by the web-taking member 23 (S3).

After the unnecessary web portion is recovered by the recovery member 23 in step S3, the counter 153 increments the count value to, e.g., "1000" which is approximation of the cumulative image forming count corresponding to the length by which the web 21 is wound. In other words, the length of the wound web is stored as the cumulative image forming count (S4).

After that, a normal image forming mode is set (S5). If the count value of the counter 153 is detected in step S2 to be larger than "0" (NO in S2), the normal image forming mode is set in step S5.

Figure 10A:
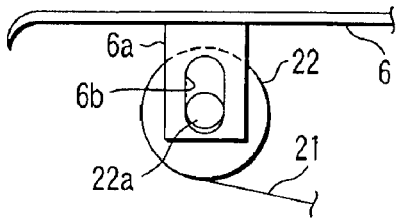
FIGS. 10A and 10B are schematic views for explaining an example of a web dismounting detection mechanism capable of detecting that the web cleaning mechanism is temporarily dismounted from the fixing device due to some reason before the web reaches its end, and then the web cleaning mechanism is mounted again.
Figure 10B:
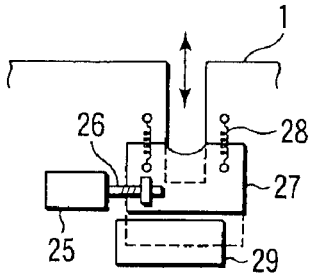

FIGS. 10A and 10B are schematic views for explaining an example of a web dismounting detection mechanism capable of detecting that the web cleaning mechanism is temporarily dismounted from the fixing device due to some reason before the web reaches its end, and then the web cleaning mechanism is mounted again.

As shown in FIG. 10A, a shaft 22*a* of the web supply member 22 of the web cleaning mechanism 6 described above with reference to FIG. 2 is supported by a housing 6*a* such that the shaft 22*a* is movable in a direction in which the shaft 22*a* comes close to/retracts from the rotating shaft of the heat roller 2 within an elongated hole 6*b* (not to be described in detail) formed in the housing 6*a* of the web cleaning mechanism.

As shown in FIG. 10B, the shaft 22*a* is set at a cleaning position where the shaft 22*a* can be normally meshed with the driving force transfer mechanism 25 which receives a driving force from the web-taking member 23. A shutter 27 arranged near the driving force transfer mechanism 25 is pushed down toward the rotation center (rotating shaft) of the heat roller 2.

The shutter 27 is arranged in the housing 6*a* such that the shutter 27 is drawn by, e.g., a spring 28 in a direction in which the shutter 27 retracts from the rotation center of the heat roller 2. Whether the shutter 27 is located at a predetermined position is always monitored by, e.g., an optical sensor (photointerrupter) 29.

When the web cleaning mechanism 6, i.e., web supply member 22 is dismounted from the fixing device 1 because of some reason, the push-down force from the shaft 22*a* to the shutter 27 toward the rotation center of the roller 2 is not applied. With the operation of the spring 28, the shutter 27 moves in a direction in which it retracts from the rotation center of the roller 2. The sensor 29 then detects that the web cleaning mechanism 6 has been dismounted from the fixing device 1. An output from the sensor 29 is input to the input port (not shown) of the main controller 151 shown in FIG. 4.

Figure 11A:
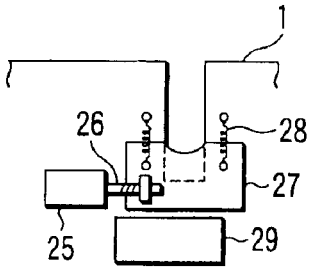
FIGS. 11A to 11C are schematic views for explaining the operation of the web cleaning mechanism dismounting detection mechanism shown in FIGS. 10A and 10B.
Figure 11B:
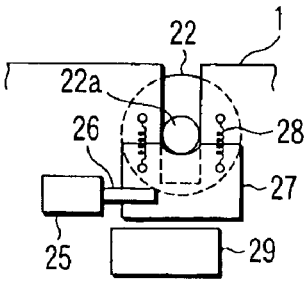
Figure 11C:
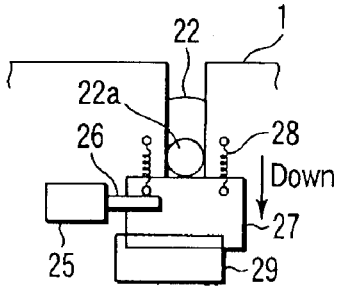

FIGS. 11A to 11C are schematic views for explaining the operation of the web cleaning mechanism dismounting detection mechanism shown in FIGS. 10A and 10B.

As shown in FIG. 11A, when the shaft 22*a*, i.e., web cleaning mechanism 6 is dismounted from the fixing device 1, the shutter 27 is moved by the spring 28 to a predetermined position spaced apart from the rotation center of the roller 2. The sensor 29 notifies the main controller 151 that the shutter 27 is open. The main controller 151 sets, e.g., "1" in a dismounting code defined by firmware (changes the dismounting code from "0" to "1").

If the web cleaning mechanism 6 is mounted in the fixing device 1 again, the shutter 27 is slightly pushed down by the shaft 22*a* of the web supply member 22 (receives a force toward the rotation center of the roller 2), as shown in FIG. 11B. In this state, the web 21 remains slacked, and the shutter 27 is not always moved to a position where the shutter 27 is detected by the sensor 29. Hence, the web dismounting code is kept at "1".

FIG. 11C shows a state in which the web 21 is taken up by a predetermined amount by the web-taking member 23 in web taking-up operation shown in FIG. 9, a predetermined tension is then applied to the web 21, and the shaft 22*a* of the web supply member 22 of the web cleaning mechanism 6 is located at a predetermined position.

As is apparent from FIG. 1C, the web taking-up process shown in FIG. 9 is executed to apply a predetermined tension to the web 21. The web 21 which has been slacked between the web supply member 22 and the press roller 24 is then taken up by the web-taking member 23. The shaft 22*a* of the web supply member 22 pushes down the shutter 27, and the sensor 29 detects the shutter 27. The sensor 29 notifies the main controller 151 that the shutter 27 is located at a predetermined position. The main controller 151 sets, e.g., "0" in the dismounting code defined by firmware (changes the dismounting code from "1" to "0").

Figure 12:
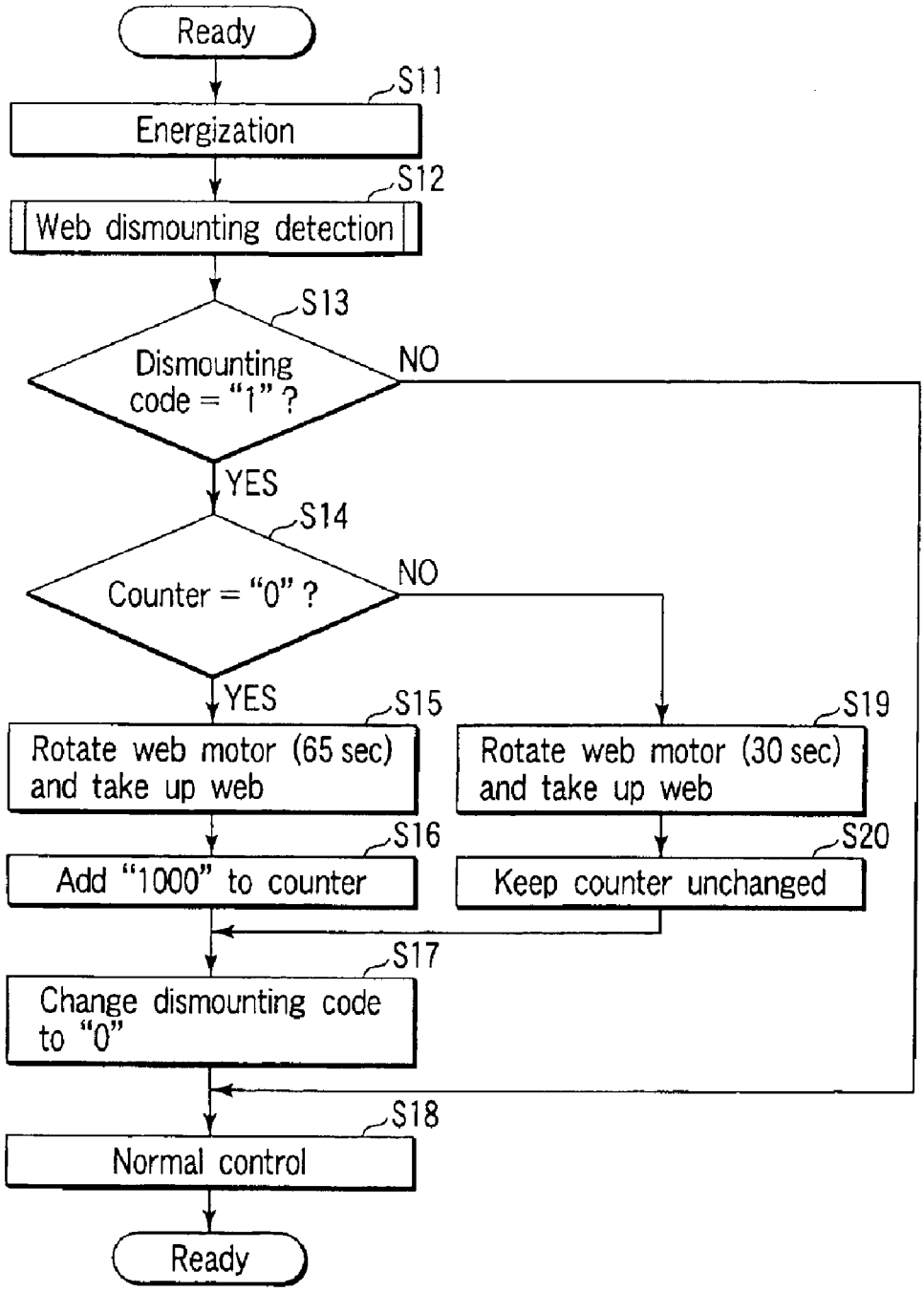
FIG. 12 is a flow chart for explaining an example of web feed control in dismounting the web cleaning mechanism before the web reaches its end.

FIG. 12 is a flow chart for explaining an example of detection of dismounting the web cleaning mechanism and web taking-up control in mounting the web cleaning mechanism again, as shown in FIGS. 10A, 10B, 11A, 11B, and 11C.

If the copying machine 101 is energized (powered on) at an arbitrary timing (S11), whether the web cleaning mechanism has been dismounted from the fixing device is checked in accordance with the web dismounting detection mechanism shown in FIGS. 10A and 10B and web dismounting detection shown in FIGS. 11A to 11C (S12).

That is, whether the dismounting code is "0" or "1" is determined (S13). If the dismounting code is "0" in step S13, the web cleaning mechanism is determined not to have been dismounted (NO in S13), and normal control to be described later is executed.

If the dismounting code is detected in step S13 to be "1" (YES in S13), the count value of the counter is checked, and whether the cleaning mechanism 6 has not been used is checked (S14).

If the count value of the counter is "0" in step S14 (YES in S14), an unused web cleaning mechanism is decided to have been mounted. The web motor 125 is rotated for a predetermined time, e.g., 65 sec (S15).

If an unnecessary web portion is recovered by the recovery member 23 in step S15, e.g., "1000" which is approximation of the cumulative image forming count corresponding to the length by which the web 21 is taken up is added to the counter 153. That is, the length of the taken-up web is stored as the cumulative image forming count (S16).

Shielding of the sensor 29 by the shutter 27 shown in FIG. 1C, i.e., whether the sensor 29 has been shielded by the shutter 27 is checked. If an output from the sensor 29 represents that the shutter 27 is located at a predetermined position, the dismounting code is returned to "0" (S17).

Thereafter, the normal image forming mode is set (S18).

If the count value of the counter is larger than "0" in step S14, the web-taking motor 125 is rotated to a degree enough to take up by the recovery member 23 an exposed portion (one turn on the outer surface of the supply member 22) of the web 21. Note that the time during which the web-taking motor 125 is rotated to recover the exposed portion of the web 21 is, e.g., 30 sec (S19).

Shielding of the sensor 29 by the shutter 27, i.e., the sensor 29 is checked. If an output from the sensor 29 represents that the shutter 27 is located at the predetermined position, the dismounting code is returned to "0" (S17). Subsequently, the normal image forming mode is set (S18).

In this manner, when the cleaning mechanism is dismounted from the fixing device or the web reaches its end in the fixing device having the web cleaning mechanism, the slack of the web is taken up prior to image formation. This can prevent a poor-quality image generated by web slack upon replacing the cleaning mechanism. When a cleaning mechanism whose web has not been used to its end is dismounted, only an exposed web portion is taken up, preventing shortening of the maintenance cycle caused by undesirably taking up the web.

As has been described above, the present invention can prevent a poor-quality image generated by rubbing an image under the influence of an unused web of a replaced cleaning mechanism in the fixing device having the web cleaning mechanism. Further, the present invention prevents undesired wear of the heat roller due to an insufficient supply amount of oil serving as a release agent.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An image forming apparatus including a fixing device with a web cleaning mechanism, comprising:

a means for detecting a web dismounting, the detecting means detects that the web cleaning mechanism is dismounted for web replacement and then mounted again; and a means for controlling a web feed, when the detecting means detects that the web cleaning mechanism is mounted, determines whether the mounted web cleaning mechanism has not been mounted before or has already been mounted, and when the web cleaning mechanism is determined not to have been mounted before, causes a web-taking unit to take up a web of the web cleaning mechanism by a predetermined amount.

2. An apparatus according to claim 1, wherein when the mounted web cleaning mechanism is determined to be a newly mounted web cleaning mechanism, the controlling means takes up the web by a predetermined amount.

3. An apparatus according to claim 1, wherein when the mounted web cleaning mechanism is determined to have temporarily been dismounted and then mounted again, the controlling means takes up at least one outermost turn of the taken-up web.

4. An apparatus according to claim 1, wherein the detecting means includes a sensor which detects a shaft position of a web supply member that supplies the web.

5. An apparatus according to claim 1, wherein the detecting means includes a sensor which detects a change in shaft position upon a change in tension applied to the web supplied from a web supply member.

6. A fixing device comprising:

a heat-producing member which is formed into a hollow cylinder or an endless belt, has an outer surface of the cylinder or a belt surface of the belt, movable at a predetermined speed, and can supply predetermined heat to a hot-melt substance and a medium holding the hot-melt substance;

a pressure application mechanism which has an outer surface that can move following the outer surface of the cylinder or the belt surface of the belt when the outer surface of the cylinder or the belt surface of the belt of the heat-producing member is moved at the predetermined speed, and which applies a predetermined pressure to the heat-producing member while interposing the hot-melt substance and the medium between the heat-producing member and the pressure application mechanism;

a heat-producing heating mechanism which is set in the heat-producing member, and allows the heat-producing member to generate heat;

a hot-melt substance-taking member which is in contact with the outer surface of the cylinder or the belt surface of the belt of the heat-producing member to be heated at a predetermined pressure, and can recover the hot-melt substance attached to the outer surface of the cylinder or the belt surface of the belt;

a hot-melt substance-taking member changer which can move the hot-melt substance taking member by a predetermined amount in a region where the hot-melt substance-taking member is in contact with the outer surface of the cylinder or the belt surface of the belt of the heat-producing member at the predetermined pressure when a predetermined amount of the hot-melt substance is attached to the hot-melt substance-taking member; and a hot-melt substance-taking member changer control device which moves the hot-melt substance-taking member at a predetermined timing in the region where the hot-melt substance-taking member is in contact with the outer surface of the cylinder or the belt surface of the belt of the heat-producing member, and when the hot-melt substance-taking member is released from the contact with the outer surface of the cylinder or the belt surface of the belt of the heat-producing member and then mounted again, or when the hot-melt substance-taking member is replaced on the basis of replacement time, moved a predetermined amount of the hot-melt substance-taking member prior to image formation, wherein when the hot-melt substance-taking member is determined to have been replaced on the basis of the replacement time, the hot-melt substance-taking member is determined to have been replaced on the basis of the replacement time, the hot-melt substance-taking member changer control device takes up a predetermined amount of the hot-melt substance-taking member, and wherein when the mounted hot-melt substance-taking member is determined to have temporarily been dismounted and then mounted again, the hot-melt substance-taking member changer control device takes up at least one outermost turn of the taken-up hot-melt substance-taking member.

7. An image forming apparatus comprising:

an image carrier which holds an electrostatic image corresponding to image information supplied as brightness and darkness of light;

a developing device which supplies toner to the electrostatic image formed on the image carrier and develops the electrostatic image;

a fixing device having a heating member for supplying predetermined heat to a toner transferred onto a medium to be transferred and a pressuring member capable of applying a predetermined pressure to the heating member, the fixing device fixes the toner developed by the developing device to the medium to be transferred that is conveyed between the heating member and the pressuring member;

a cleaning mechanism which includes a web that is arranged to be able to contact the heating member of the fixing device at a predetermined pressure during supply from a supply end to an arriving-end, and be able to change by a predetermined amount a position where the web is in contact with the heating member of the fixing device by recovering the web to the arriving-end when the medium to be transferred passes through the fixing device a predetermined number of times, and that supplies a predetermined amount of oil serving as a release agent to the heating member and removes toner which is not transferred to the medium to be transferred and remains; and a control mechanism which determines whether the cleaning mechanism has not been mounted before or has already been mounted in the fixing device, and when the cleaning mechanism is determined not to have been mounted before, causes the recovery end to take up the web by a predetermined amount.

8. An image forming apparatus according to claim 7, wherein when the cleaning mechanism is determined to be a newly mounted cleaning mechanism, the control mechanism takes up the web by a predetermined amount by which an oil supply amount is stabilized.

9. An image forming apparatus according to claim 7, wherein when the cleaning mechanism is determined to have temporarily been dismounted and then mounted again, the control mechanism takes up at least one outermost turn of the taken-up web.

10. An image forming apparatus including a fixing device with a web cleaning mechanism, comprising:

a web dismounting detection mechanism which detects that the web cleaning mechanism is dismounted for web replacement and then mounted again; and a web feed control mechanism which, when the web dismounting detection mechanism detects that the web cleaning mechanism is mounted, determines whether the mounted web cleaning mechanism has not been mounted before or has already been mounted, and when the web cleaning mechanism is determined not to have been mounted before, causes a web-taking unit to take up a web of the web cleaning mechanism by a predetermined amount.

11. An apparatus according to claim 10, wherein when the mounted web cleaning mechanism is determined to be a newly mounted web cleaning mechanism, the web feed control mechanism takes up the web by a predetermined amount.

12. An apparatus according to claim 10, wherein when the mounted web cleaning mechanism is determined to have temporarily been dismounted and then mounted again, the web feed control mechanism takes up at least one outermost turn of the taken-up web.

13. An apparatus according to claim 10, wherein the web dismounting detection mechanism includes a sensor which detects a shaft position of a web supply member that supplies the web.

14. An apparatus according to claim 13, wherein the web dismounting detection mechanism includes a sensor which detects a change in shaft position upon a change in tension applied to the web supplied from the web supply member.

15. A fixing device comprising:

a means for generating heat, the generating heat means is formed into a hollow cylinder or an endless belt, has an outer surface of the cylinder or a belt surface of the belt movable at a predetermined speed, and can supply predetermined heat to a hot-melt substance and a medium holding the hot-melt substance;

a means for applying pressure, the pressure applying means has an outer surface that can move following the outer surface of the cylinder or the belt surface of the belt when the outer surface of the cylinder or the belt surface of the belt of the generating heat means is moved at the predetermined speed, and which applies a predetermined pressure to the generating heat means while interposing the hot-melt substance and the medium between the generating heat means and the pressure applying means;

a means for heating the generating heat means, the heating means is set in the generating heat means, and allows the generating heat means to generate heat;

a means for taking a hot-melt substance member, the taking means is in contact with the outer surface of the cylinder or the belt surface of the belt of the generating heat means to be heated at a predetermined pressure, and can recover the hot-melt substance attached to the outer surface of the cylinder or the belt surface of the belt;

a means for moving the taking means, the moving means can move the taking means by a predetermined amount in a region where the taking means is in contact with the outer surface of the cylinder or the belt surface of the belt of the generating heat means at the predetermined pressure when a predetermined amount of the hot-melt substance is attached to the taking means; and a means for controlling the moving means, the controlling means moves the taking means at a predetermined timing in the region where the taking means is in contact with the outer surface of the cylinder or the belt surface of the belt of the generating heat means, and when the taking means is released from the contact with the outer surface of the cylinder or the belt surface of the belt of the generating heat means and then mounted again, or when the taking means is replaced on the basis of replacement time, moved a predetermined amount of the taking means prior to image formation;

wherein when the mounted taking means is determined to have temporarily been dismounted and then mounted again, the controlling means takes up at least one outermost turn of the taken-up taking means.

16. An image forming apparatus comprising:

a means for carrying image, the carrying means holds an electrostatic image corresponding to image information supplied as brightness and darkness of light;

a means for developing, the developing means supplies toner to the electrostatic image formed on the carrying means and develops the electrostatic image;

a means for fixing, the fixing means has a heating member for supplying predetermined heat to a toner transferred onto a medium to be transferred and a pressuring member capable of applying a predetermined pressure to the heating member, the fixing means fixes the toner developed by the developing means to the medium to be transferred that is conveyed between the heating member and the pressuring member;

a means for cleaning, the cleaning means includes a web that is arranged to be able to contact the heating member of the fixing means at a predetermined pressure during supply from a supply end to an arriving-end, and be able to change by a predetermined amount a position where the web is in contact with the heating member of the fixing means by recovering the web to the arriving-end when the medium to be transferred passes through the fixing means a predetermined number of times, and that supplies a predetermined amount of oil serving as a release agent to the heating member and removes toner which is not transferred to the medium to be transferred and remains; and a means for controlling, the controlling means determines whether the cleaning means has not been mounted before or has already been mounted in the fixing means, and when the cleaning means is determined not to have been mounted before, causes the recovery end to take up the web by a predetermined amount.

17. An image forming apparatus according to claim 16, wherein when the cleaning means is determined to be a newly mounted cleaning means, the control means takes up the web by a predetermined amount by which an oil supply amount is stabilized.

18. An image forming apparatus according to claim 16, wherein when the cleaning means is determined to have temporarily been dismounted and then mounted again, the control means takes up at least one outermost turn of the taken-up web.

19. A method of operating a web cleaning mechanism which is mounted on a fixing device, comprising:

detecting whether or not the web cleaning mechanism has been dismounted for web replacement before;

in the event that the web cleaning mechanism has been dismounted before, determining whether the mounted web cleaning mechanism has not been mounted before or has already been mounted, and in the event that the web cleaning mechanism has not been mounted before, causing a web-taking unit to take up a web of the web cleaning mechanism by a predetermined amount.

20. A method of operating a web cleaning mechanism which is mounted on a fixing device according to claim 19, wherein when it is detected that the mounted web cleaning mechanism is a newly mounted web cleaning mechanism, taking up the web by a predetermined amount.

21. A method of operating a web cleaning mechanism which is mounted on a fixing device according to claim 19, wherein when it is determined that the mounted web cleaning mechanism has temporarily been dismounted and then mounted again, taking up at least one outermost turn of the taken-up web.

22. A method of operating a web cleaning mechanism which is mounted on a fixing device according to claim 19, wherein the web cleaning mechanism comprises a web dismounting detection mechanism including a sensor which detects a shaft position of a web supply member that supplies a web.

23. A method of operating a web cleaning mechanism which is mounted on a fixing device according to claim 22, wherein the web dismounting detection mechanism includes a sensor which detects a change in shaft position in response to a change in tension applied to the web supplied from the web supply member.

* * * * *